US008657966B2

(12) United States Patent
Kalyankar et al.

(10) Patent No.: US 8,657,966 B2
(45) Date of Patent: Feb. 25, 2014

(54) COMBINATORIAL APPROACH TO THE DEVELOPMENT OF CLEANING FORMULATIONS FOR GLUE REMOVAL IN SEMICONDUCTOR APPLICATIONS

(75) Inventors: Nikhil D. Kalyankar, Hayward, CA (US); Chi-I Lang, Cupertino, CA (US); Zachary Fresco, Redwood City, CA (US)

(73) Assignee: Intermolecular, Inc., San Jose, CA (US)

( * ) Notice: Subject to any disclaimer, the term of this patent is extended or adjusted under 35 U.S.C. 154(b) by 164 days.

(21) Appl. No.: 13/058,803

(22) PCT Filed: Aug. 12, 2009

(86) PCT No.: PCT/US2009/053624

§ 371 (c)(1),
(2), (4) Date: Feb. 11, 2011

(87) PCT Pub. No.: WO2010/019722

PCT Pub. Date: Feb. 18, 2010

(65) Prior Publication Data

US 2011/0146727 A1 Jun. 23, 2011

Related U.S. Application Data

(60) Provisional application No. 61/110,443, filed on Jan. 15, 2009, provisional application No. 61/138,068, filed on Dec. 16, 2008, provisional application No. 61/088,471, filed on Aug. 13, 2008.

(51) Int. Cl.
*B08B 3/00* (2006.01)
*C11D 7/00* (2006.01)

(52) U.S. Cl.
USPC ..... 134/28; 134/26; 134/34; 510/175; 510/200

(58) Field of Classification Search
None
See application file for complete search history.

(56) References Cited

U.S. PATENT DOCUMENTS

| | | | | |
|---|---|---|---|---|
| 5,883,013 | A * | 3/1999 | Noguchi et al. | 438/780 |
| 6,140,027 | A | 10/2000 | Baik et al. | |
| 2003/0132423 | A1 | 7/2003 | Garvia | |
| 2003/0171233 | A1 | 9/2003 | Abe et al. | |
| 2005/0066995 | A1 * | 3/2005 | Coico et al. | 134/2 |
| 2005/0090416 | A1 * | 4/2005 | Lee et al. | 510/175 |
| 2006/0078671 | A1 * | 4/2006 | Lee et al. | 427/66 |
| 2008/0039356 | A1 * | 2/2008 | Palmer et al. | 510/424 |
| 2008/0131789 | A1 * | 6/2008 | Kumar | 430/5 |
| 2008/0206578 | A1 * | 8/2008 | Rantala et al. | 428/447 |
| 2008/0264441 | A1 * | 10/2008 | Takagi | 134/1 |

FOREIGN PATENT DOCUMENTS

| | | | |
|---|---|---|---|
| JP | 05-070797 | | 3/1993 |
| JP | 2001-313290 | | 11/2001 |
| KR | 10-2003-0069266 | | 8/2003 |
| WO | WO 2008080097 | A2 * | 7/2008 |

* cited by examiner

*Primary Examiner* — Nicole Blan

(57) ABSTRACT

Embodiments of the current invention describe cleaning solutions to clean the surface of a photomask, methods of cleaning the photomask using at least one of the cleaning solutions, and combinatorial methods of formulating the cleaning solutions. The cleaning solutions are formulated to preserve the optical properties of the photomask, and in particular, of a phase-shifting photomask.

15 Claims, 8 Drawing Sheets

COMBINATORIAL APPROACH TO THE DEVELOPMENT OF CLEANING FORMULATIONS FOR GLUE REMOVAL IN SEMICONDUCTOR APPLICATIONS

CROSS-REFERENCE TO RELATED APPLICATIONS

This application is a Patent Cooperation Treaty national-phase application claiming priority to PCT App. Ser. No. PCT/US09/053624 filed 12 Aug. 2009, which itself claims priority to U.S. Prov. Pat. App. Ser. Nos. 61/110,443 filed 15 Jan. 2009, 61/138,068 filed 16 Dec. 2008, and 61/088,471 filed 13 Aug. 2008, all of which are entirely incorporated by reference herein for all purposes.

FIELD OF THE INVENTION

The present invention relates generally to semiconductor processing. More specifically, a cleaning solution for the removal of pellicle glue is described, along with methods of applying the cleaning solution and combinatorially developing the cleaning solution.

BACKGROUND OF THE INVENTION

The patterning of semiconductor substrates requires the use of photomasks to project the pattern to be etched, either positive or negative, onto a photoresist. Because photomasks are repetitively imaged during their lifetime, a single defect can have a significant cumulative effect on yields. Defects may be in the form of residue or haze. Haze is typically the result of a chemical film or residue adsorbed to the photomask surface. These photomasks are becoming increasingly complex and expensive. Ideally, manufacturers should be able to clean photomasks multiple times to save costs. This is becoming increasingly difficult because of the materials used on the photomasks for the patterned layer and the fine features of the patterned layer. The photomasks are typically formed of chromium (Cr) or molybdenum silicide (MoSi) patterned layer formed over glass or quartz substrates. The cleaning of half-tone, or phase-shifting, masks presents greater challenges because the optical characteristics (such as transmittance and phase angle) must remain unchanged. The cleaning solution used must not etch the quartz or degrade the patterned layer of the photomask.

Additionally, the photomask needs to be cleaned regularly due to the build-up of a haze on the surface of the photomask under the pellicle during photolithography processing. The pellicle is an optically clear film that is suspended over the photomask by a frame that is glued to the surface of the photomask. To clean the photomask the pellicle and pellicle frame are removed. A residue of pellicle glue remains on the surface of the photomask. Thus, the cleaning solution used to clean the photomask not only needs to be extremely sensitive to the surface of the photomask such that the optical properties are not damaged, but the cleaning solution also needs to be able to remove the pellicle glue and the haze. If the pellicle glue is not removed and residues are left on the photomask this causes significant problems and the photomask cannot be reused.

The pellicle glue is typically a silicone adhesive. The removal of silicone residues from photomasks currently requires some kind of mechanical removal in addition to a chemical treatment. Heat is also typically required to remove the silicone pellicle glue. The mechanical removal may be followed by a high pressure rinse. Mechanical removal, high pressure, and heat are potentially very damaging to the patterned layer a photomask, and in particular to a patterned layer formed of a phase-shifting material such as MoSi. Additionally, multiple cleaning steps and rinses are required along with the mechanical removal. The multiple cleaning steps increase the likelihood that the photomask will be damaged.

BRIEF DESCRIPTION OF THE DRAWINGS

Various embodiments of the invention are disclosed in the following detailed description and the accompanying drawings.

DETAILED DESCRIPTION

A detailed description of one or more embodiments is provided below along with accompanying figures. The detailed description is provided in connection with such embodiments, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For the purpose of clarity, technical material that is known in the technical fields related to the embodiments has not been described in detail to avoid unnecessarily obscuring the description.

Embodiments of the current invention describe a cleaning solution to clean the surface of a photomask, methods of cleaning the photomask using the cleaning solution, and combinatorial methods of formulating a cleaning solution. The cleaning solution is formulated to preserve the optical properties of the photomask. In one embodiment, the cleaning solution is also formulated to clean a photomask in a single application of the cleaning solution. In other embodiments, the cleaning solutions and methods are optimized to clean a phase shift photomask. In one embodiment, a "one step" cleaning solution is formed of an organic acid, a fluoride source, and an organic solvent. In other embodiments, more than one cleaning solution may be used in a multi-step cleaning process. In one such embodiment, a first cleaning solution is formed of an organic solvent and a first active ingredient, and a second cleaning solution is formed of an organic solvent and a second active ingredient. The first active ingredient may be a fluoride source or an organic acid and the second ingredient is also either a fluoride source or an organic acid. For example, the first cleaning solution may be formed of the organic solvent and the fluoride source and the second cleaning solution would then be formed of the organic solvent and the organic acid. Similarly, if the first cleaning solution is formed of the organic solvent and the organic acid, the second cleaning solution would be formed of the organic solvent and the fluoride source.

Figure 1:
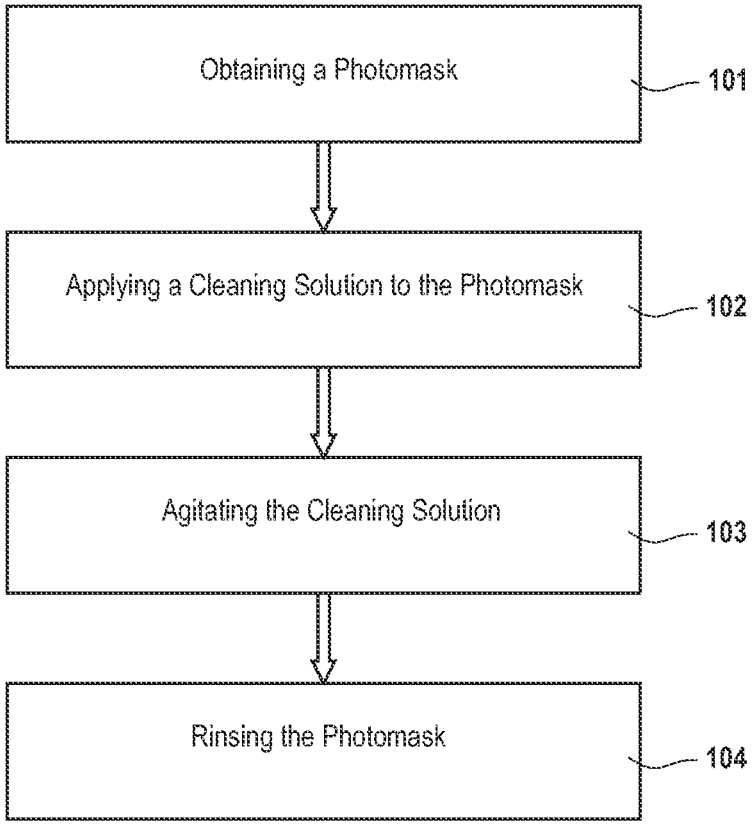
FIG. 1 is a flowchart describing a cleaning process for cleaning a photomask according to various embodiments.
Figure 2A:
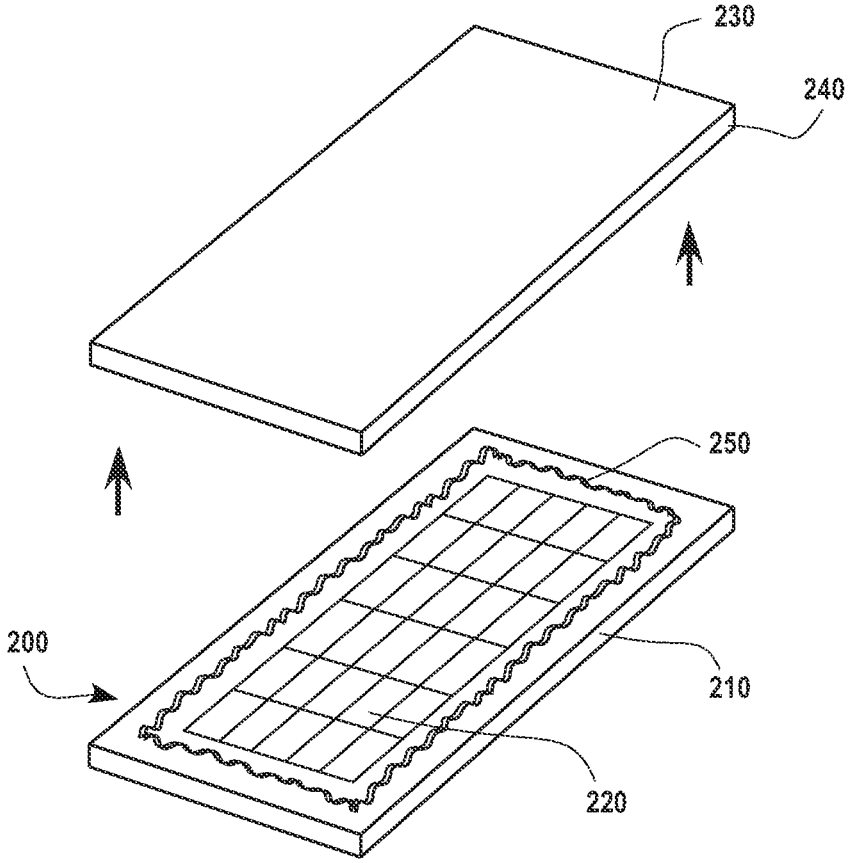
FIGS. 2A-2B illustrates a photomask and pellicle glue removal according to various embodiments.
Figure 2B:
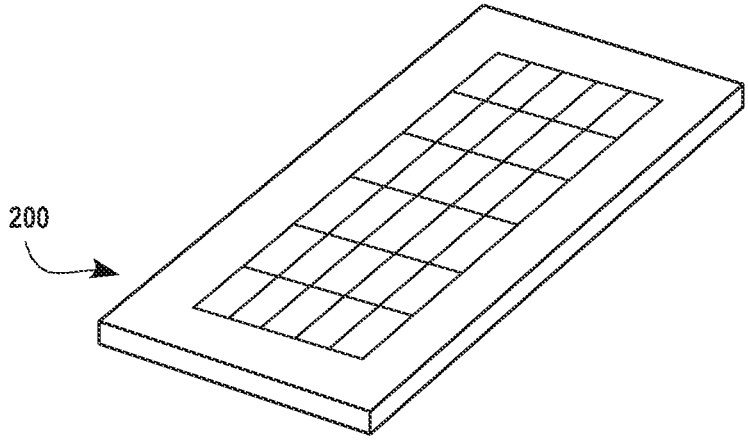

At block 101 of the flowchart in FIG. 1A, a photomask is provided to be cleaned. Photomasks are used for photolithographically patterning surfaces in the field of semiconductor technologies. A photomask is used in lithography operations to replicate features of the photomask onto various manufacturing substrates, such as integrated circuits on semiconductor wafers. As the features on semiconductor substrates are scaled down the photomasks become more important in ensuring that the critical dimensions of the patterned features are met. FIG. 2 illustrates a photomask 200 formed of a substrate 210, such as glass or quartz, and a patterned layer 220. The patterned layer 220 may be an opaque material such as a metal to form what is known as a binary photomask. The metals used for a binary photomask may be, for example, chromium, chromium oxide, or even MoSi. In other embodiments the patterned layer 220 may be a phase-shifting semi-transparent material such as a molybdenum containing compound. The molybdenum containing compound may be molybdenum silicide (MoSi) or MoSiON. After multiple photolithographic exposures the photomask 200 accumulates deposits, known as a haze, that could affect the performance of the photomask 200. At this point the photomask 200 is cleaned to remove the haze. The haze forms on the patterned surface of the photomask 200 that is sealed under the pellicle 230 and the pellicle frame 240, necessitating the removal of the pellicle 230 and the pellicle frame 240 from the surface of the photomask 200. The pellicle frame 240 is glued to the surface of the photomask 200 and the pellicle glue 250 will remain on the surface of the photomask 200 after removal of the pellicle frame 240. The pellicle glue 250 may be a silicone based compound, such as polydimethylsiloxane (PDMS) or an acrylate compound.

At block 102 of FIG. 1A, the photomask 200 is cleaned by applying a cleaning solution to remove the pellicle glue 250 from the surface of the photomask 200. The cleaning solution may be applied to the photomask 200 by any method known in the art, such as liquid dispense, spray, or bath immersion. In the embodiment shown in the flowchart of FIG. 1A, a "one step" cleaning solution is formed of an organic acid, a fluoride source, and an organic solvent. In photomasks, and in phase-shift photomasks in particular, the cleaning solutions and methodologies used must maintain the optical properties of the photomask to be able to clean and reuse the photomask more than once. Additionally, molybdenum containing compounds are very sensitive to chemical cleaning. As such, embodiments of the cleaning solution are formulated to preserve the optical properties of the photomask and to be sensitive enough to clean the photomask on multiple occasions, thereby increasing the lifetime of the photomask. The combination of an organic acid, a fluoride source, and an organic solvent provide these advantages, either formulated in one cleaning solution or in two cleaning solutions.

The organic acid is selected from a sulfonic acid, a carboxylic acid and a phosphonic acid. The sulfonic acid may be, for example, 4-dodecylbenzenesulfonic acid, para-toluene sulfonic acid, or methane sulfonic acid. The carboxylic acid may be, for example, acetic acid or citric acid. The fluoride source may be any compound that acts as a source of the fluoride ion. The fluoride source may be, for example, tetrabutylammonium fluoride (TBAF) or HF. The organic solvent is selected because it is miscible with the pellicle glue 250. In an embodiment where the pellicle glue is polydimethylsiloxane (PDMS) the organic solvent that is selected for the cleaning solution may be, for example, diisopropylame, pentane, xylene, tetrahydrofuran (THF), or chloroform. Each of these organic solvents is miscible with PDMS. Various solvents swell PDMS to different extents based on their ability of mixing with PDMS:

$\Delta Gm = \Delta Hm - T\,\Delta Sm$, where $\Delta Gm$ is the free energy change of mixing; $\Delta Hm$ is the heat of mixing and $\Delta Sm$ is the entropy change of mixing.

$\Delta Hm = Vm\Phi 1\ \Phi 2\ (\delta 1 - \delta 2)^2$, where $\delta$ is the solubility parameter and $\Phi$ is the volume fraction of components 1 & 2.

For maximum $\Delta Gm$, $\Delta Hm \rightarrow 0$ i.e. $\delta 1 \sim \delta 2$; thus the two components need to have nearly identical solubility parameters to be able to mix efficiently. In other words, solvents with $\delta$ close to glue are extremely miscible with the glue and swell the glue network more.

In an alternate embodiment, the cleaning solution may be semi-aqueous by the addition of deionized water. This may be done to increase the solubility of the cleaning solution with the pellicle glue if water is miscible with the pellicle glue.

The components of the cleaning solution to remove the pellicle glue 250 from the photomask 200 are selected based on their different functions. The organic solvent is selected based on its miscibility with the pellicle glue 250. When an organic solvent is miscible with the pellicle glue 250 it will swell the network of chemical bonds within the pellicle glue 250. It is theorized that the swelling enhances the interaction between the pellicle glue 250, the fluoride source and the organic acid. It is also theorized that the combination of the fluoride source and the organic acid breaks the chemical bonds within the pellicle glue 250, which is a polymer.

The combination of the fluoride source and the organic acid breaks the bonds of the polymer to form smaller oligomers, thereby dissolving the pellicle glue 250 so that it can be removed by the cleaning solution. The fluoride source and the organic acid may be applied in a single step or separately in more than one step, as will be described with reference to FIG. 1B. The dissolution of the chemical bonds of the pellicle glue 250 may also break up the cross-linking between the polymers, further enhancing the dissolution of the pellicle glue 250. This dissolution is particularly effective for the portion of the pellicle glue 250 that is closest to the quartz surfaces of the photomask surface where the amount of cross-linking is the highest due to its continuous exposure to ultraviolet light during the photolithography processes. The addition of chemical components to the cleaning solution that dissolve the pellicle glue 250, as opposed to delamination of the pellicle glue 250, provide for a more gentle cleaning of the photomask 200 that does not require any scraping or peeling of the pellicle glue residue from the surface of the photomask 200. As such, the cleaning solution may preserve the optical qualities of the photomask 200 to a greater extent than cleaning solutions that rely on the delamination of the pellicle glue because it may not be necessary to apply mechanical contact or external forces to the photomask 200.

The combination of components in the cleaning solution may also allow for the removal of the pellicle glue residue from the surface of the photomask 200 with a single application of the cleaning solution. Without being bound by theory, it is believed that the ability of the cleaning solution to swell, solvate, and break the chemical bonds of the pellicle glue while also washing away the pellicle glue 250 once it is broken down that allows for the cleaning to be performed in a single application of the cleaning solution.

The cleaning solution may include additional components that can further enhance the preservation of the optical qualities of the photomask. A corrosion inhibitor may be added to prevent corrosion of metals, such as chrome or MoSi, that are used to form the patterned layer 220 of the photomask 200.

Examples of corrosion inhibitors include, for example, benzotriazole (BTA), uric acid, ascorbic acid, and 2-methylbenzoic acid (2-MBA). Another additive may be a photomask surface modifier that can form a monolayer of material on the photomask to protect the surface. For example, polymeric compounds having different polarities on opposite ends, such as a polyvinyl alcohol (PVA) compound, may be used to form the monolayer through self-assembly on the surface of the photomask 200. In an embodiment, the surface modifier may be included in the cleaning solution when it is formulated to be semi-aqueous because the surface modifier compounds tend to be polar compounds similar to water. The surface modifier can be selected to adhere to the entire surface of the photomask 200 or selectively to the substrate 210 or to the patterned layer 220. The surface modifier would adhere to the surface of the photomask 200 through weak bonds that will easily break and wash away along with the cleaning solution once the cleaning solution is removed from the surface of the photomask 200.

At block 103 of the flowchart of FIG. 1A, the cleaning may be enhanced by agitating the cleaning solution. This may be accomplished by stirring, shaking, or by applying ultrasonic or megasonic energy to the cleaning solution or the substrate. Temperature may also be applied to the substrate to help remove the hardest, most cross-linked pellicle glue 250. The temperature applied may be in the range of 25° C. and 120° C., but cannot be higher than the flash point of the organic solvent used for the formulation development. Agitating the cleaning solution or applying heat to the substrate may increase the removal rate of the pellicle glue 250 from the photomask 200.

At block 104 of FIG. 1A, the photomask may be rinsed to further remove the cleaning solution and any remaining pellicle glue residue. The rinsing may be done once or multiple times using an organic solvent that will prevent precipitation of dissolved reagents and glue residue from the solution and will also be water miscible, such as tetrahydrofuran (THF), isopropanol, or acetone.

In one particular embodiment, the cleaning solution has been formulated to remove PDMS pellicle glue from the surface of a phaseshift photomask that includes both chrome and MoSi on quartz. The cleaning solution in this embodiment is formed of 0.1M TBAF and 0.4M acetic acid in THF. The temperature of the cleaning solution is approximately room temperature (25° C.) and is applied to the substrate for approximately 50 minutes. In an alternate embodiment, the cleaning solution has been formulated to remove an acrylate pellicle glue from the surface of a phaseshift mask that is formed of both chrome and MoSi on quartz. The cleaning solution in this embodiment includes 0.3M TBAF and 0.2M dodecylbutylsulfonic acid in THF. The phase shift photomask is cleaning by submersion in a bath of the cleaning solution at room temperature (25° C.) for approximately one hour.

In some embodiments where the photomask is especially sensitive to the active ingredients within the cleaning solution, the cleaning process includes multiple steps to remove the pellicle glue. These embodiments may be appropriate when the photomask is a phase-shift photomask formed of chrome and molybdenum on a quartz substrate. The cleaning processes using multiple steps to remove the pellicle glue may be designed to minimize the time that both of the active ingredients are together on the photomask. There are multiple possible embodiments of multi-step cleaning methodologies for the cleaning of pellicle glue from a photomask, and in particular a phase-shift photomask having features formed of MoSi or another molybdenum containing compound. In these embodiments, the methodologies were developed to improve the selectivity between the dissolution of the pellicle glue and the etching of the MoSi by the cleaning solutions. The overriding theme in these embodiments of cleaning methodologies is that they are created to minimize the time that both of the active ingredients, the fluoride source and the organic acid, are applied to the photomask. The goal is to minimize the impact of the cleaning solution on the optical properties and the critical dimensions of the photomask, and in particular a phase-shift photomask.

Figure 1B:
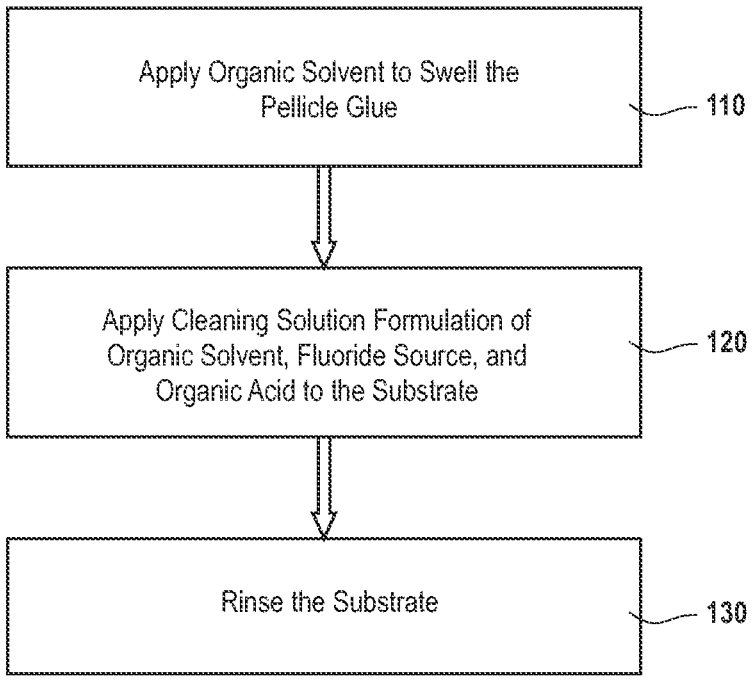

In one embodiment, the cleaning process is modified as shown in the flowchart of FIG. 1B. At block 110, an organic solvent is applied to the pellicle glue for a time sufficient to swell the pellicle glue. The organic solvent may be any of the organic solvents listed above, such as tetrahydrofuran (THF). The amount of time that it takes to swell the pellicle glue will vary depending on the type of pellicle glue. For example, if the pellicle glue is PDMS the organic solvent is applied for a time in the range of 5 min and 60 min. It is theorized that the swelling will enhance the interaction between the pellicle glue 250, the fluoride source and the organic acid during the subsequent application of the cleaning solution in block 120 of FIG. 1B. At block 120, a cleaning solution formed of an organic solvent and both of the active ingredients is applied to the photomask. The active ingredients are the fluoride source and the organic acid, such as those described above. In one particular embodiment the cleaning solution is a concentrated solution of the organic solvent, the fluoride source, and the organic acid. For example, the concentrated solution may be 0.1-0.4 M Tetrabutylammonium fluoride (TBAF) and 0.1-0.4 M Acetic Acid in Tetrahydrofuran (THF). The concentrated solution may even be a mixture of only the fluoride source and the organic acid, for example 1.0 M TBAF in THF and 100% glacial Acetic Acid. A concentrated solution may require less time to remove the pellicle glue. This may be advantageous to minimize the amount of time that the active ingredients are in contact with the chrome and, particularly, with the MoSi on the photomask to reduce the impact of the cleaning solution on the optical qualities of the photomask. This may especially be the case if the concentrated cleaning solution formed of only the active ingredients is accompanied by some sort of physical agitation of the substrate such as megasonic energy, ultra-sonic energy, or mechanical agitation.

The cleaning solution may be removed from the photomask by spinning the substrate. Or, the photomask may be rinsed at block 130 of FIG. 1B. The rinsing may be done to ensure complete removal of the active ingredients from the surface of the photomask and to thereby prevent any potential etching of the chrome or MoSi by the active ingredients. The rinse may be the same organic solvent that was used in the previous two steps or it may be a different solvent such as isopropanol, ethanol, and deionioned water.

Figure 1C:
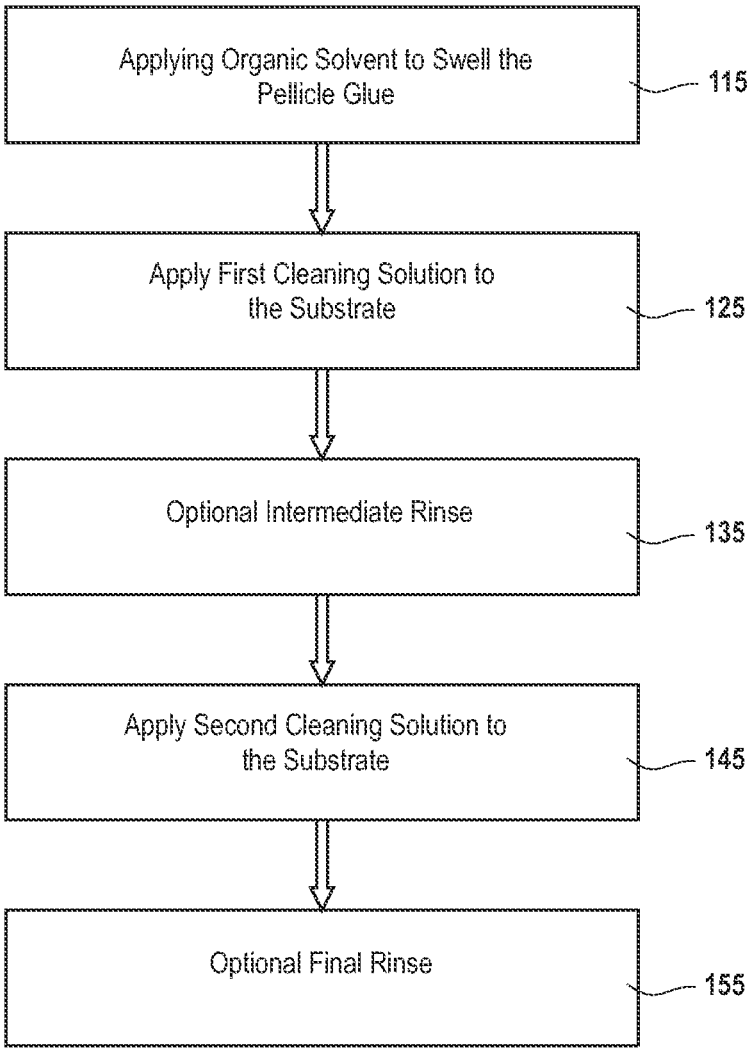

FIG. 1C is a flowchart showing another possible embodiment of the cleaning process. In this embodiment, there are two cleaning solutions applied to the photomask. At block 115, an organic solvent may optionally be applied to the photomask for a time sufficient to swell the pellicle glue. In some instances the swelling of the pellicle glue requires the bulk of the removal time. By applying only the organic solvent initially until the glue has been swelled, then the amount of time that both of the active ingredients are applied to the photomask can be minimized. A first cleaning solution formed of an organic solvent and a first active ingredient is applied to the photomask at block 125 of the flowchart of FIG. 1C, and a second cleaning solution formed of an organic solvent and a second active ingredient is applied to the photomask at block 135 of FIG. 1C. The first active ingredient may be a fluoride source or an organic acid and the second ingredient is also either a fluoride source or an organic acid. For example, the first cleaning solution may be formed of the organic solvent and the fluoride source and the second cleaning solution would then be formed of the organic solvent and the organic acid. Similarly, if the first cleaning solution is formed of the organic solvent and the organic acid, the second cleaning solution would be formed of the organic solvent and the fluoride source. In the instance where the organic solvent is not first applied to the photomask at block 115 to swell the pellicle glue, the first cleaning solution will be applied for a time sufficient to swell the pellicle glue. Regardless of whether the organic solvent alone or the first cleaning solution is used to swell the pellicle glue, it is theorized that the first active ingredient in the first cleaning solution will absorb into the pellicle glue along with the organic solvent. The first active ingredient may then combine with the second active ingredient at block 145 when the second cleaning solution is applied to the photomask. It is further theorized that the combination of the first and second active ingredients is optimal for the breaking of the bonds of the polymer structure of the pellicle glue.

In one embodiment, an intermediate rinse is applied to the photomask after the application of the first cleaning solution at block 125 but before the application of the second cleaning solution at block 145. This rinse at block 135 may be valuable in removing the first active ingredient from the surface of the photomask and in particular from the regions of the photomask that include the MoSi features. Therefore, only one of the active ingredients will be in contact with the sensitive MoSi features at any given time minimizing the possibility that the optical properties of the photomask will be affected by the cleaning solution. But, both of the active ingredients will be able to combine to remove the pellicle glue because it is theorized that the first active ingredient will absorb into the pellicle glue during the application of the first cleaning solution and the second active ingredient will also absorb into the pellicle glue during the application of the second cleaning solution. In this way, the optimal cleaning properties of the combination of both of the active ingredients can be applied to the pellicle glue without having any potential adverse affect on the MoSi. The optional intermediate rinse may be an organic solvent, such as the same organic solvent used in the first and second cleaning solutions, or another organic solvent. Alternatively, the rinse may be a different solvent that would be good at removing the second active ingredient, such as isopropanol, ethanol, and deionized water.

At block 155, a rinse may be applied to the photomask to remove any remaining cleaning solution and pellicle glue. As described above, the rinse may be combined with mechanical agitation applied to remove the pellicle glue or acoustic energy applied to the photomask substrate to enhance the cleaning.

In one embodiment, a multi-step cleaning process is used to remove PDMS pellicle glue from the surface of a phase-shift photomask that includes both chrome and MoSi on quartz. In this embodiment, a 0.01-0.1 M TBAF in THF solution is applied first for 10 minutes followed by 0.2-0.4 M Acetic Acid in THF for 10 minutes. This is then followed by rinsing using plenty of isopropanol followed by a deionized (DI) water rinse.

Combinatorial Methodology

Figure 3:
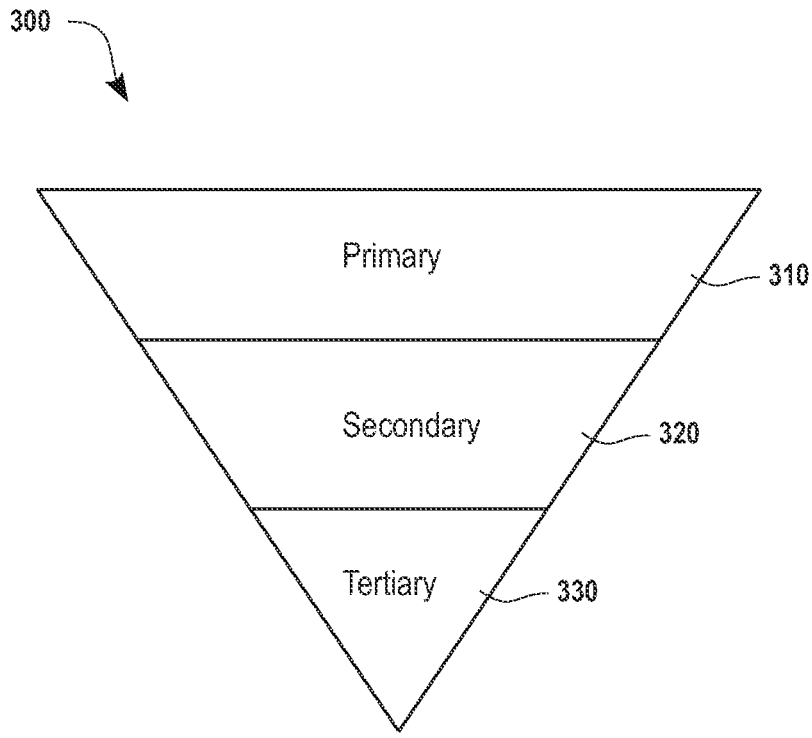
FIG. 3 is a diagram representing a funnel of different screening levels in combinatorial processing.

The cleaning solution may be developed using combinatorial methods of formulating the cleaning solution. Combinatorial processing may include any processing that varies the processing conditions in two or more regions of a substrate. The combinatorial methodology, in embodiments of the current invention, includes multiple levels of screening to select the cleaning solutions for further variation and optimization. In an embodiment, the cleaning solution is optimized to preserve the optical properties of the photomask, and in particular, of a phase-shifting photomask. In another embodiment, the cleaning solution is optimized to clean the photomask in a single application of the cleaning solution. In yet another embodiment, the cleaning solution and cleaning method is optimized to minimize impact on a phase-shifting photomask, and in particular the MoSi features on the phase-shifting photomask. FIG. 3 illustrates a diagram 300 showing three levels of screening for the development of the cleaning solution using combinatorial methodologies. The diagram 300 shows a funnel, where the primary screening 310 includes the largest number of samples of cleaning solutions funneling down to the secondary screening 320 and the tertiary screening 330 where the least number of samples of the cleaning solutions are tested. The number of samples used at any of the screening levels may be dependent on the substrate or tools used to process the samples.

In one particular embodiment of the current invention, the screening at the different levels of the funnel is designed to formulate a photomask cleaning solution that is optimized to effectively remove a pellicle glue from the photomask without degrading the optical properties of the substrate. At the primary screening level 310 of this embodiment, the cleaning solution is combinatorially screened in a high throughput manner to determine the ability of the cleaning solution to effectively remove the pellicle glue from a photomask. The combinatorial screening process used is as outlined in the flowchart illustrated in FIG. 4. The primary screening level 310, in one particular embodiment, tests for the removal of a pellicle glue from a quartz substrate. The pellicle glue may be a silicone based or an acrylate based material. At block 401 of the flowchart of FIG. 4, the method begins by first defining multiple regions 510 of a substrate 500 as illustrated in FIG. 5. A region of a substrate may be any portion of the substrate that is somehow defined, for example by dividing the substrate into regions having predetermined dimensions or by using physical barriers, such as sleeves, over the substrate. The region may or may not be isolated from other regions. In the embodiment illustrated in FIG. 5, the regions 510 may be defined by multiple sleeves that are in contact with the surface of the substrate 500. The number of regions 510 defined by sleeves is only limited by the tools used for the combinatorial processing. As such, multiple experiments may be performed on the same substrate, and any number of regions may be defined. For example, five cleaning solutions may be tested using fifteen regions of a substrate, each cleaning solution being tested three times.

In this embodiment, the substrate 500 may be a quartz substrate where each of the multiple regions 510 includes a portion of a pellicle glue 520 and a portion of exposed quartz 530. At block 402 of the flowchart in FIG. 4, the multiple regions 510 of the substrate 500 are processed in a combinatorial manner. In an embodiment, this is done by formulating a plurality of varied cleaning solutions at block 403 of the flowchart in FIG. 4. In one embodiment, this involves formulating multiple cleaning solutions having methodically varied components by varying at least one of a chemical component selected from an organic acid, a fluoride source, and an organic solvent. At block 404, the varied cleaning solutions are applied to the multiple regions 510 of the substrate 500. A single varied cleaning solution is applied to each of the multiple regions 510 for a predetermined amount of time. In one particular embodiment the cleaning solution is applied for up to one hour to determine whether the cleaning solution can remove the pellicle glue within one hour. In this example, if a cleaning solution cannot remove the pellicle glue in an hour, then it is screened out of consideration.

At block 405, the performance of each of the varied cleaning solutions is characterized. The characterization is performed to determine how effectively each of the varied cleaning solutions removes the pellicle glue 520 from each of the regions 510. The characterization is performed by first taking images of the substrate using optical microscopy. The initial optical microscopy images are taken at a scale of 5 mm×5 mm. The optical microscopy images will provide the information about whether the glue has been completely or mostly removed. For each region, images are taken of both the area where the pellicle glue 520 had been placed and the area 530 of exposed quartz that had not been covered with the pellicle glue film. From these images it can be determined whether the pellicle glue 520 was removed or leaves a residue on any part of the substrate within the region 510.

The screening then includes a second characterization of the regions 510 where the glue appeared to be completely removed based on the optical microscopy images. The regions 510 where the glue appeared to be completely removed are then characterized by AFM measurements to evaluate the roughness of the substrate and the removal of the pellicle glue on a finer scale. The AFM measurements have a resolution on the order of micrometers and may provide information on glue residue that remains on a finer scale. The AFM measurements provide the root means square (rms) average of the roughness of a region of the substrate to provide a measure of the roughness of the surface in nanometers. This characterization process includes measuring at least two areas of each region, one being the area where the glue was originally and the other being the area of originally exposed substrate. If the roughness measurement provided by AFM scans are within the standard deviation of the pre-scan of the quartz substrate, then it is concluded that the cleaning solution did not have an impact on the substrate and completely removed the pellicle glue. Using this information, a subset of the varied cleaning solutions is then selected for further varying and processing at block 406 of the flowchart in FIG. 4. A subset of cleaning solutions is selected based on which solutions completely removed the pellicle glue and had no impact on the roughness of the quartz substrate. In an embodiment, the subset of cleaning solutions is also selected based on the ability of the cleaning solution to remove the pellicle glue in a single application. In another embodiment, the subset of cleaning solutions may be further narrowed based on which cleaning solutions meet the criteria for more than one type of pellicle glue. In one embodiment, the primary screening process described above is applied to two types of glue, a silicon-based glue such a PDMS, and an acrylate-based pellicle glue. In this embodiment, the subset of cleaning solutions is selected based on which cleaning solutions could completely remove both the silicone-based glue and the acrylate based glue without having any impact on the substrates. For example, two different cleaning solutions that can remove both a silicone-based glue (PDMS) and an acrylate glue from a quartz substrate have been developed using this methodology. One of these cleaning solutions is formulated with 0.1M-0.4M TBAF (as the fluoride source) and 0.1M-0.4M acetic acid in THF as the organic solvent. In one particular embodiment the formulation is 0.1M TBAF and 0.4M acetic acid in THF. The second cleaning solution that can remove both types of glue is at least 0.1M-0.4M TBAF and 0.1-0.4M dodecylbenzenesulfonic acid in THF. In one particular embodiment, the formulation for the second cleaning solution is 0.3M TBAF and 0.2M dodecylbenzenesulfonic acid in THF.

Figure 6:
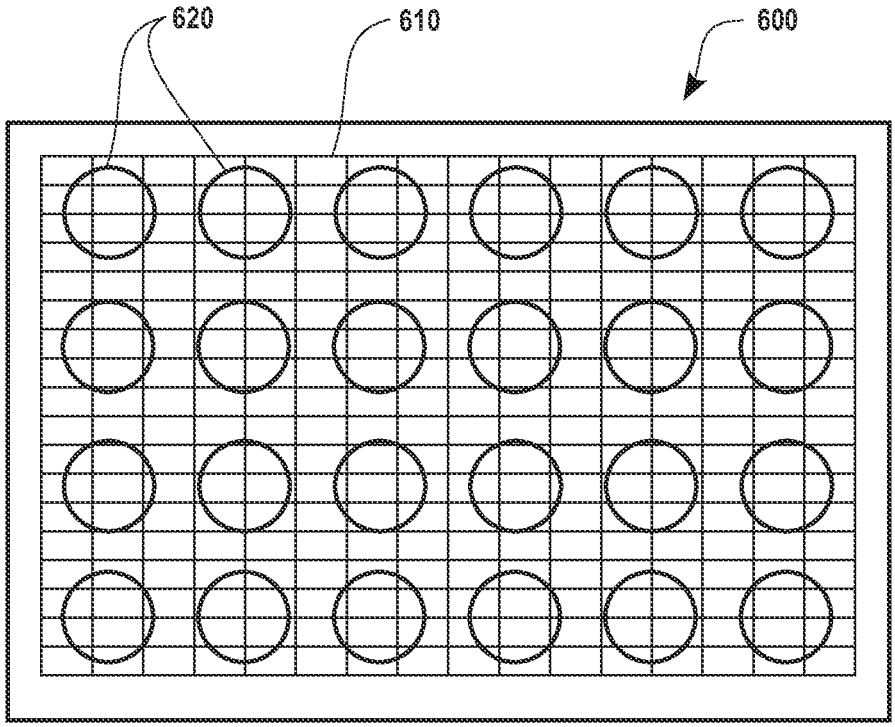
FIG. 6 illustrates a photomask substrate for combinatorial processing according to an embodiment of the current invention.

The combinatorial methodology then funnels down to the secondary screening 320 of FIG. 3. The subset of selected cleaning solutions from the primary screening 310 is then tested on an actual photomask substrate 600 that includes a patterned layer 610, as illustrated in FIG. 6. The photomask 600 may be a binary photomask formed of a quartz substrate and a chrome patterned layer or a phase-shift photomask formed of a quartz substrate and a patterned layer of a molybdenum-containing compound, such as molybdenum silicide (MoSi). The phase-shift photomasks may be a combination of chrome and MoSi. The secondary screening is performed to determine the impact of the cleaning solution on the patterned layer of a photomask, the patterned layer being chrome, MoSi, or a combination of chrome and MoSi. For the secondary screening the photomask may or may not have a film of pellicle glue. The primary screening has already tested the ability of the cleaning solutions to remove the glue, so the secondary screening, which is done using more expensive substrates (actual photomasks) can be done without the glue. The secondary screening uses the same methodology as the primary screening, as outlined in the flowchart of FIG. 4. After defining the multiple regions on the photomask substrate 600 at block 401, using similar methods as described above, the multiple regions 620 of the photomask substrate 600 are processed in a combinatorial manner at block 402. The processing in a combinatorial manner is performed by formulating a plurality of varied cleaning solutions at block 403 based on the subset of cleaning solutions selected at the end of the primary screening process. At block 404 these selected cleaning solutions are applied to the multiple regions 620 of the photomask 600 to determine the impact of the cleaning solution on the patterned layer 610 of the photomask 600. The cleaning solutions are applied to the multiple regions for the amount of time it was determined was needed in the primary screening to remove the pellicle glue from the substrate. Through the use of this amount of time the cleaning can be simulated to evaluate the impact of the cleaning solution on the substrate.

The performance of each of the cleaning solutions applied to the multiple regions of the substrate is then characterized at block 405. The performance of the cleaning solutions is characterized to determine the impact of the cleaning solution on the patterned layer. The characterization is done by measuring not only the roughness (rms) of the quartz substrate but also the line width and height of the patterned features using AFM measurements. The height and line width of the patterned features are measured in a pre-scan along with the roughness of the exposed quartz substrate. The pre- and post-scans of the height and width determine whether the patterned chrome or MoSi features of the photomask have been eroded/etched either vertically or horizontally. The pre- and post-scans of the roughness of the exposed quartz determine whether the cleaning solution has any impact on the quartz. If there is no statistically significant difference between the pre- and post-scans, meaning that the post-scan measurements are within the standard deviation of the pre-scan, then it is concluded that the cleaning solution has not had an impact on the patterned layer or the quartz substrate of the photomask. At block 406 a subset of the varied cleaning solutions is selected for further varying and processing based on the characterization data. The cleaning solutions selected for processing in the tertiary screening level 330 are those for which it was concluded that there is no (or minimum tolerable) impact on the photomask.

The tertiary screening level 330 of the combinatorial funnel will perform the final screening of the cleaning solutions. In an embodiment, the number of cleaning solutions at this screening level may be less than ten, in one particular embodiment the number of cleaning solutions may be one or two, but could be any number. The final screening will optimize the cleaning solution to preserve the optical properties of the photomask. The cleaning solution is used to clean pellicle glue off of a photomask and the optical properties of the photomask are then tested to screen the final batch of cleaning solution. The photomasks are tested by using the photomask in a photolithographic process to pattern a photoresist material on a semiconductor substrate. The semiconductor substrates are then processed, using techniques that are well known to those of skill in the art, to form features. For example, if the semiconductor substrate is being patterned to form a logic device, then the photoresist is used as a pattern to etch an interlayer dielectric material into which copper can be plated to form interconnect lines. The interconnect lines must have a width that falls within a very small margin of error due to the very small scale of the interconnect lines desired in the final device. As such, the etched portions of the dielectric material must meet the critical dimensions of the final device and cannot have line edge roughness that will affect the final dimensions of the interconnect lines. Therefore, the photomask can affect the critical dimensions and line edge roughness of the features etched into the substrate on which the photoresist has been formed. The characterization of the cleaning solution at the tertiary screening level 303 will measure the dimensions of the patterned photoresist to determine whether the optical qualities of the photomask have been affected by the cleaning solution. The photomasks that pass this test will indicate which of the cleaning solutions can be used to clean photomasks in production. The ability to clean and reuse photomasks is cost effective.

In an alternate embodiment, the combinatorial screening includes preliminary screening using a substitute material to test the etch rate of the molybedenum-containing compound used to form the features on the photomask, and in particular to test the etch rate of MoSi. A high-thoughput methodology has been developed to test the etch rate of MoSi by correlation of the MoSi etch rate to the etch rate of another material for testing purposes. In the embodiment described herein, the material used as a substitute for MoSi is thermal oxide formed on a silicon substrate. A thermal oxide layer is formed on a silicon substrate by exposing the silicon to heat and moisture—thus, the formation of a "thermal oxide." The etch rate of the thermal oxide is correlated to MoSi by applying multiple cleaning formulations to the thermal oxide and comparing the etch rate of the thermal oxide to data collected on the etch rate of those same cleaning formulations on MoSi. Data is collected on the absolute amount of material etched vs. time to determine the etch rate. Once it has been determined that the etch rate of thermal oxide correlates to the etch rate of MoSi, the cheaper thermal oxide substrates can be used as part of the primary screening of the cleaning formulations in the combinatorial methodology. The correlation of thermal oxide to MoSi also takes into consideration the likely impact on the optical qualities of the photomask, such as percent transmission of light through the mask, critical dimensions of the features patterned by the photomask, and impact of the cleaning solution the phaseshifting properties of the photomask.

Figure 4:
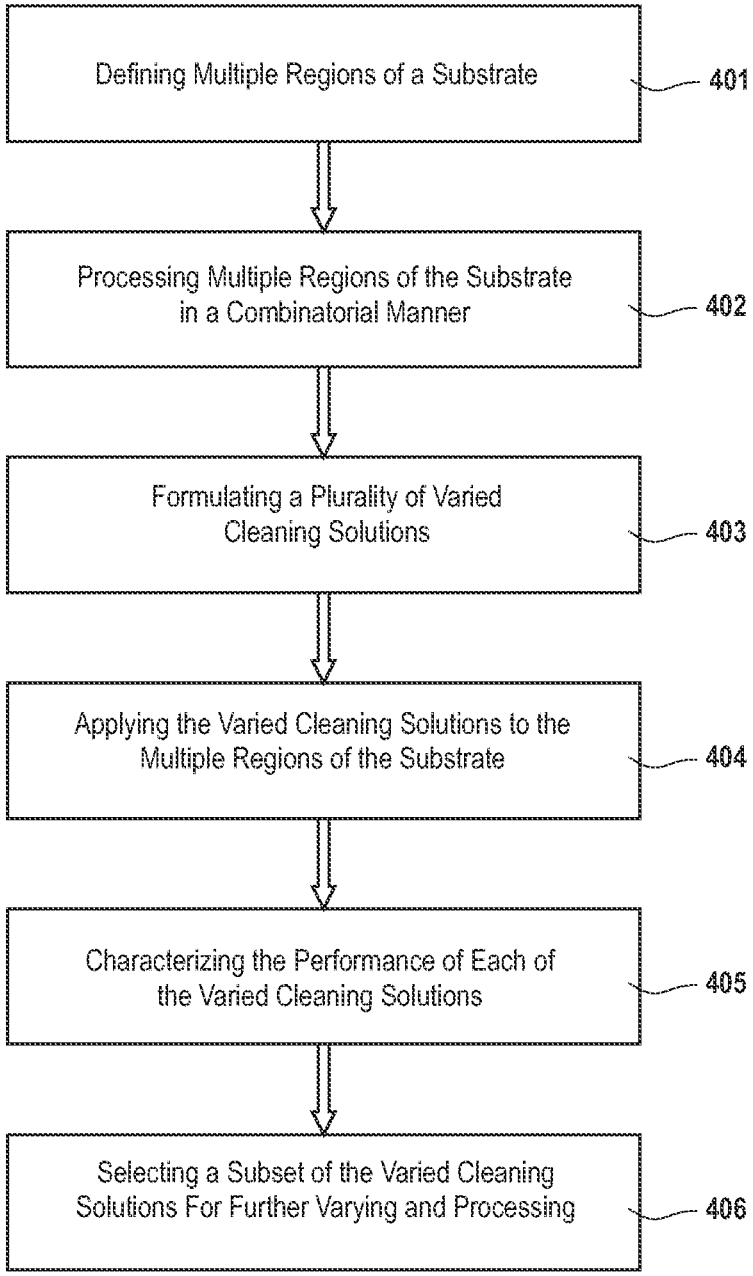
FIG. 4 is a flowchart describing a combinatorial processing method for photomask cleaning solutions.
Figure 5:
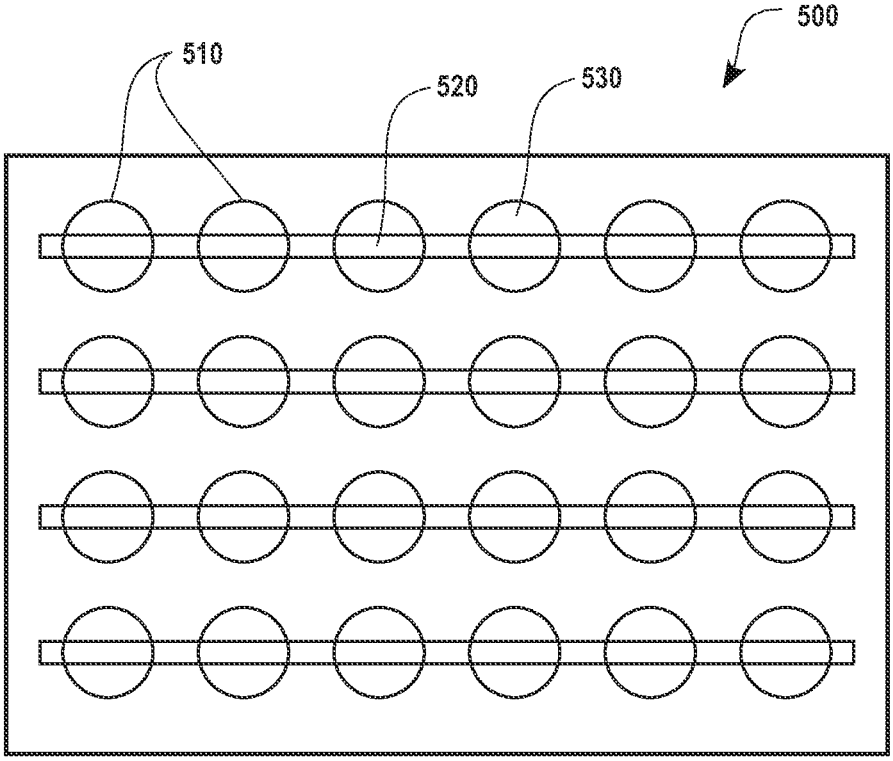
FIG. 5 illustrates a substrate for combinatorial processing according to an embodiment of the current invention.

After the correlation study, the methodology outlined in FIG. 4 can be applied to the thermal oxide substrate. At block 401 multiple regions of the silicon substrate having a thermal oxide are defined. A region of the substrate may be any portion of the substrate that is somehow defined, for example by dividing the substrate into regions having predetermined dimensions or by using physical barriers, such as sleeves, over the substrate. Multiple regions of the thermal oxide substrate may then be processed in a combinatorial manner at block 402. To do this a plurality of varied cleaning solutions is formulated at block 403 and then applied to the multiple regions of the substrate at block 404. For example, the cleaning solutions can be an organic solvent with one or two active ingredients, the active ingredients being a fluoride source and an organic acid. The cleaning solution can be formed of an organic solvent, a fluoride source and an organic acid. Alternatively, the cleaning solution can be formed of an organic solvent and only one of the active ingredients, either the fluoride source or the organic acid. These different basic cleaning solutions can be varied by varying one or more of the organic solvent, the fluoride source, or the organic acid or by varying the concentrations of the components in the solution, or by varying the time duration that the cleaning solution is applied to the substrate.

After applying the varied cleaning solutions to the multiple regions of the substrate the performance of each of the varied cleaning solutions is characterized at block 406. The cleaning solutions that have the least effect on the thermal oxide in terms of etching will be selected as part of the subset of the cleaning solutions that are used in the next screening level. In one embodiment, it was determined that the cleaning solutions formed of the organic solvent plus one active ingredient had the least effect on the thermal oxide etch rate. In this embodiment, one of the specific cleaning solutions was formed of the organic solvent tetrahydrofuran (THF) and the fluoride source TBAF and the other specific cleaning solution was formed of THF and the organic acid acetic acid. These cleaning solutions were found to have minimal impact on the thermal oxide and thus could be correlated to have minimal impact on the MoSi features of a photomask. Both of the active ingredients combined in a single cleaning formulation were found to significantly etch the thermal oxide and thus can also be correlated to having a significant etch rate on MoSi. But, in some embodiments, both of the active ingredients are optimal for the removal of pellicle glue from a photomask. As such, a multistep cleaning methodology was developed to expose the photomask to both of the active ingredients with minimal impact to the MoSi. These multistep cleaning methodologies were tested combinatorially using the subset of cleaning solutions identified by the tests performed on the thermal oxide.

Although the foregoing examples have been described in some detail for purposes of clarity of understanding, the invention is not limited to the details provided. There are many alternative ways of implementing the invention. For example, the phrases primary, secondary and tertiary screening are arbitrary and can be intermixed or modified as necessary: different substrates can be used for different levels, information from the secondary screening can be fed back into the primary screening to change the initial screening, or to provide additional variable for that screening, the various screening levels can be run partially in parallel to enable feeding back information, or other modifications to the screening funnel can be made by those of skill in the art. The disclosed examples are illustrative and not restrictive.

A method, comprising: defining multiple regions of a substrate; processing the multiple regions of the substrate in a combinatorial manner, wherein the processing comprises: formulating a plurality of varied cleaning solutions having methodically varied components; applying the plurality of varied cleaning solutions to the multiple regions of the substrate; and characterizing a performance of each of the varied cleaning solutions to select a subset of the varied cleaning solutions for further variation and processing.

The method above, wherein the substrate comprises quartz, a binary photomask comprising quartz and chrome, a phase-shift photomask comprising quartz, chrome and molybdenum silicide, or other applicable substrate.

The method above, wherein formulating the plurality of cleaning solutions having methodically varied components comprises varying at least one of a chemical component selected from the group consisting of an organic acid, a fluoride source, and an organic solvent, or the concentration of at least one of an organic acid, a fluoride source, and an organic solvent.

The method above, wherein characterizing the performance comprises measuring the roughness of the substrate using AFM and optical microscopy measurements or a pre-thickness and a post-thickness of a film formed on the substrate.

The method above, wherein the film formed on the substrate is MoSi.

The method above, further comprising selecting the subset of the varied cleaning solutions for further variation and processing based on whether any damage to an exposed portion of the substrate has occurred.

The method above, further comprising selecting the subset of the varied cleaning solutions for further variation and processing based on whether an effective removal of the portion of the pellicle glue film from the substrate has occurred.

The method above, wherein further variation and processing comprises combinatorially optimizing the results achieved by the subset of the varied cleaning solutions.

The method above, wherein the subset of the varied cleaning solutions is optimized to remove the pellicle glue from the substrate in a single step such that the substrate can be cleaned multiple times without degrading the substrate or to not affect the optical properties of the substrate.

A cleaning solution to remove a pellicle glue from a photomask, comprising: an organic acid selected from the group consisting of sulfonic acid, a carboxylic acid, and a phosphonic acid; a fluoride source; and an organic solvent that is miscible with the pellicle glue.

The cleaning solution of above, wherein the organic solvent has a solubility parameter matched to polydimethylsiloxane (PDMS).

The cleaning solution of above, further comprising a corrosion inhibitor.

The cleaning solution of above, further comprising a photomask surface modifier.

The cleaning solution of above, wherein the photomask surface modifier comprises a polyvinyl acetate (PVA) compound.

A method comprising: obtaining a photomask; and applying a cleaning solution comprising an organic acid, a fluoride source, and an organic solvent to a photomask to remove a pellicle glue from a surface of the photomask.

The method of above further comprising processing a wafer using the photomask, and detecting a characteristic of the photomask to determine if the cleaning is needed prior to applying the cleaning solution to the photomask.

The method of above further comprising checking the photomask to determine if it can be used in processing a wafer, and reusing the photomask in the processing.

What is claimed:

1. A cleaning solution to remove a pellicle glue from a photomask, consisting essentially of:

an organic acid selected from the group consisting of a carboxylic acid and a phosphonic acid;

a fluoride source; and an organic solvent that is miscible with the pellicle glue.

2. The cleaning solution of claim 1, wherein the organic acid is a carboxylic acid.

3. The cleaning solution of claim 1, wherein the fluoride source comprises tetrabutylammonium fluoride (TBAF).

4. The cleaning solution of claim 1, wherein the organic solvent is tetrahydrofuran (THF).

5. The cleaning solution of claim 1, wherein the pellicle glue is selected from a group consisting of a silicone glue and an acrylate glue.

6. The cleaning solution of claim 1, wherein the organic acid is a phosphonic acid.

7. A method comprising:

obtaining a photomask; and applying a cleaning solution consisting essentially of an organic acid, a fluoride source, and an organic solvent to a photomask to remove a pellicle glue from a surface of the photomask, wherein the organic acid is selected from the group consisting of a carboxylic acid and a phosphonic acid.

8. The method of claim 7, wherein applying the cleaning solution to the photomask removes the pellicle glue from the surface of the photomask with a single application of the cleaning solution.

9. The method of claim 7, further comprising agitating the cleaning solution.

10. The method of claim 7, further comprising heating the cleaning solution.

11. The method of claim 7, further comprising rinsing the photomask.

12. The method of claim 7, wherein the photomask comprises a phase-shift photomask comprising quartz, chromium and molybdenum silicide (MoSi).

13. A method of cleaning a photomask, comprising:

applying a first cleaning solution to the photomask, wherein the first cleaning solution consists essentially of an organic solvent and an organic acid selected from the group consisting of a carboxylic acid and a phosphonic acid;

applying a second cleaning solution to the photomask, wherein the second cleaning solution comprises the organic solvent and a fluoride source; and after the applying of the first cleaning solution and before the applying of the second cleaning solution, applying a rinsing solution to the photomask.

14. The method of claim 13, wherein the rinsing solution comprises the organic solvent.

15. The method of claim 14, further comprising applying the organic solvent to the photomask before applying the first cleaning solution.

* * * * *